US011180169B2

(12) United States Patent
Asano et al.

(10) Patent No.: US 11,180,169 B2
(45) Date of Patent: Nov. 23, 2021

(54) ONBOARD SYSTEM, GROUND SYSTEM, AND INFORMATION TRANSMISSION SYSTEM

(71) Applicants: KYOSAN ELECTRIC MFG. CO., LTD., Yokohama (JP); Social System Development Laboratory Co., Ltd., Tokyo (JP)

(72) Inventors: Akira Asano, Yokohama (JP); Yuichirou Shimizu, Yokohama (JP); Tomonori Itagaki, Kawasaki (JP); Tetsuya Takata, Kanagawa (JP); Hideo Nakamura, Tokyo (JP)

(73) Assignees: KYOSAN ELECTRIC MFG. CO., LTD., Yokohama (JP); Social System Development Laboratory Co., Ltd., Tokyo (JP)

( * ) Notice: Subject to any disclaimer, the term of this patent is extended or adjusted under 35 U.S.C. 154(b) by 629 days.

(21) Appl. No.: 16/034,443

(22) Filed: Jul. 13, 2018

(65) Prior Publication Data

US 2019/0023292 A1 Jan. 24, 2019

(30) Foreign Application Priority Data

Jul. 18, 2017 (JP) ..... JP2017-139122

(51) Int. Cl.
*B61L 15/00* (2006.01)
*H01Q 1/32* (2006.01)
(Continued)

(52) U.S. Cl.
CPC ..... *B61L 15/0027* (2013.01); *B61L 3/125* (2013.01); *B61L 27/0005* (2013.01);
(Continued)

(58) Field of Classification Search
CPC ..... B61L 3/12; B61L 3/125; B61L 15/0027; B61L 27/0005; B61L 2205/00; H01Q 1/3225; H01Q 21/08; H01Q 1/3275
See application file for complete search history.

(56) References Cited

U.S. PATENT DOCUMENTS 4,768,740 A * 9/1988 Corrie ..... B61L 3/121 246/25
8,164,530 B2 * 4/2012 Rhodes ..... H01Q 21/06 343/742
(Continued)

FOREIGN PATENT DOCUMENTS

JP H11-255124 A 9/1999
JP 2007-325418 A 12/2007
(Continued)

*Primary Examiner* — Zachary L Kuhfuss
(74) *Attorney, Agent, or Firm* — Muncy, Geissler, Olds & Lowe, P.C.

(57) ABSTRACT

An information transmission system includes a ground system provided to a track and an onboard system installed in a train. The ground system includes two (M=2) track antennae selected from N types of track antennae with different resonance frequencies. The two track antennae are arranged side by side in a left and right direction relative to a traveling direction of the train. When the train passes through a position where the ground system is provided, the onboard system detects the two track antennae at once and can determine the resonance frequencies of the track antennae.

12 Claims, 3 Drawing Sheets

(51) Int. Cl.

| | |
|---|---|
| ***B61L 27/00*** | (2006.01) |
| ***B61L 3/12*** | (2006.01) |
| ***H01Q 21/08*** | (2006.01) |

(52) U.S. Cl.
CPC ..... *H01Q 1/3225* (2013.01); *H01Q 21/08* (2013.01); *B61L 2205/00* (2013.01)

(56) References Cited

U.S. PATENT DOCUMENTS

| | | | | |
|---|---|---|---|---|
| 9,162,689 | B2 * | 10/2015 | Itagaki | B61L 1/10 |
| 9,216,749 | B2 * | 12/2015 | Itagaki | B61L 1/02 |
| 9,654,181 | B1 * | 5/2017 | Wobak | H04B 17/101 |
| 2014/0156135 | A1 * | 6/2014 | Maki | B61L 15/0027 701/29.1 |
| 2015/0198712 | A1 * | 7/2015 | Soderi | G01S 13/765 342/47 |

FOREIGN PATENT DOCUMENTS

| | | | |
|---|---|---|---|
| JP | 2012-186878 | A | 9/2012 |
| JP | 2013-021745 | A | 1/2013 |

* cited by examiner

ONBOARD SYSTEM, GROUND SYSTEM, AND INFORMATION TRANSMISSION SYSTEM

The content of Japanese Patent Application No. 2017-139122 filed on Jul. 18, 2017 is incorporated herein by reference.

BACKGROUND

Automatic train stop (ATS) systems currently in practical use can be roughly classified into a frequency shift type ATS and a transponder based ATS, on the basis of the structure of a track antenna. The frequency shift type ATS system uses a track antenna having a resonance circuit and an onboard antenna emitting a predetermined frequency signal. Specifically, shifting of the signal frequency of the onboard antenna to the resonance frequency of the track antenna is detected. The onboard system performs traveling control on the basis of the detected resonance frequency, by referring to a database stored in advance (see, for example, JP-A-2013-021745).

In conventional frequency shift type ATS systems, only a single track antenna has been provided to a single track antenna installed position. Thus, the type of information that can be transmitted to the onboard system at a single track antenna installed position depends on the number of types of possible resonance frequencies of the track antenna. Logically, the types of information that can be transmitted can be increased by increasing the types of the track antenna (resonance frequencies). The types of information that can be transmitted can also be increased without increasing the types of track antennae, for example, with a combination of the resonance frequencies of a plurality of track antennae, arranged at a predetermined interval along a railway track direction, regarded as a single piece of information. In this method, however, each time a track antenna is detected by the onboard system, it is required to determine whether or not the information transmission is completed with the detected track antenna alone, or whether or not the information transmission involving a previously detected track antenna has not been completed yet because another track antenna will be detected later as a part of the combination to complete the information transmission. Furthermore, a plurality of track antennae to be a single combination need to be detected one by one, and thus it takes time to complete the detection for all the antennae.

SUMMARY

According to the first aspect of the invention, there is provided an onboard system installed in a train that travels along a track, the track having a track antenna installed position where M types of track antennae selected from N types of track antennae with different resonance frequencies are arranged side by side in a left and right direction relative to a traveling direction or arranged to be entirely or partially overlap with each other in a vertical direction, N being larger than M, M being equal to or larger than 2, the onboard system comprising:

a transmission control section causing an onboard antenna to transmit a predetermined signal, the onboard antenna generating frequency signals corresponding to a resonance frequency of the track antennae when the onboard antenna and the track antennae resonate;

a determination section determining the M types of track antennae at the track antenna installed position, on the basis of the frequency signals generated in the onboard antenna when the train passes through the track antenna installed position; and a traveling control section performing traveling control for the train on the basis of a determination result obtained by the determination section.

According to the second aspect of the invention, there is provided a ground system provided to a track along which a train including the onboard system travels, the ground system comprising M types of track antennae selected from N types of track antennae with different resonance frequencies, N being larger than M, M being equal to or larger than 2, the M types of track antennae being arranged side by side in a left and right direction relative to a traveling direction of the train or arranged to be partially or entirely overlapped with each other in a vertical direction.

A third aspect of the present invention is an information transmission system comprising: the onboard system described above; and a ground system including M types of track antennae selected from N types of track antennae with different resonance frequencies, N being larger than M, M being equal to or larger than 2, the M types of track antennae being arranged side by side in a left and right direction relative to a traveling direction of the train or arranged to be partially or entirely overlapped with each other in a vertical direction.

DESCRIPTION OF EXEMPLARY EMBODIMENTS

Figure 1:
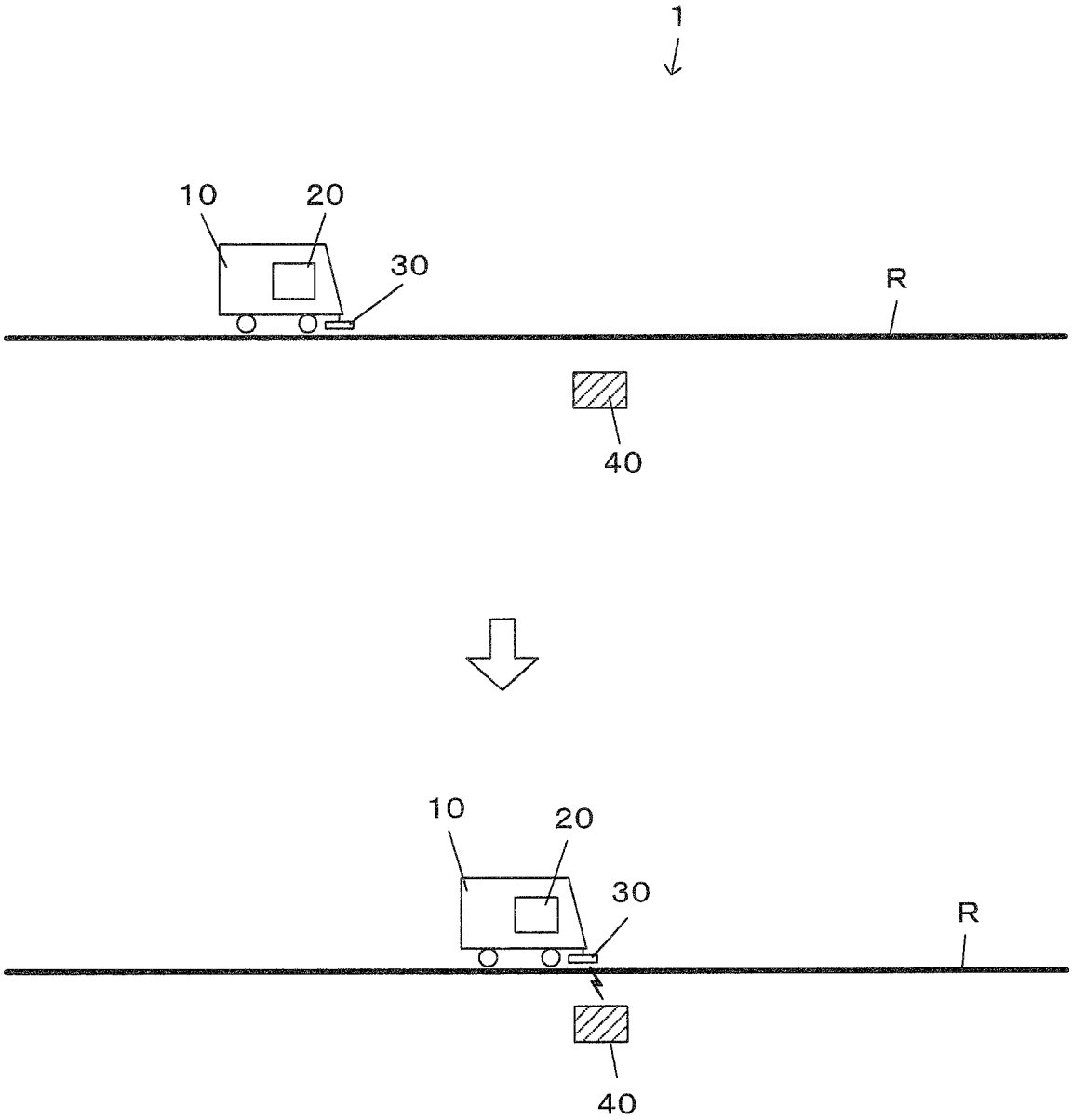
FIG. 1 is a diagram illustrating a configuration of an information transmission system.

The present embodiment can provide a technique suitable for increasing the types of information transmitted from a track antenna to an onboard system, without increasing the types of the track antennae.

According to one embodiment of the invention, there is provided an onboard system installed in a train that travels along a track, the track having a track antenna installed position where M types of track antennae selected from N types of track antennae with different resonance frequencies are arranged side by side in a left and right direction relative to a traveling direction or arranged to be entirely or partially overlap with each other in a vertical direction, N being larger than M, M being equal to or larger than 2, the onboard system comprising:

a transmission control section causing an onboard antenna to transmit a predetermined signal, the onboard antenna generating frequency signals corresponding to a resonance frequency of the track antennae when the onboard antenna and the track antennae resonate;

a determination section determining the M types of track antennae at the track antenna installed position, on the basis of the frequency signals generated in the onboard antenna when the train passes through the track antenna installed position; and a traveling control section performing traveling control for the train on the basis of a determination result obtained by the determination section.

With this configuration, the M types of track antennae at the track antenna installed position are arranged side by side in the left and right direction relative to the traveling direction or arranged to be partially or entirely overlapped with each other in the vertical direction. Thus, the onboard system can detect the M types of track antennae at once, and determine their resonance frequencies. If a combination of the M types of resonance frequencies detected/determined at once is regarded as a single piece of information, a wider range of information can be transmitted to the onboard system from the ground system than in a case where a single track antenna is provided at the track antenna installed position.

In one of the above onboard systems, the determination section may perform calculating a Q factor of each of the N types of resonance frequencies on the basis of the frequency signal, and determining the M types of track antennae at the track antenna installed position, on the basis of a resonance frequency corresponding to the Q factor satisfying a predetermined threshold condition.

With this configuration, the resonance frequency can be accurately determined by using the Q factor. For example, the resonance frequency of a track antenna can also be determined by using a resonance level. However, the resonance level is affected by swinging of a vehicle body and noise. The determination using the Q factor is not affected by the swinging of the vehicle body or noise, and thus can achieve more accurate determination of the resonance frequency than in the case where the resonance level is used.

According to another embodiment of the invention, there is provided a ground system provided to a track along which a train including one of the above onboard systems travels, the ground system may comprise M types of track antennae selected from N types of track antennae with different resonance frequencies, N being larger than M, M being equal to or larger than 2, the M types of track antennae being arranged side by side in a left and right direction relative to a traveling direction of the train or arranged to be partially or entirely overlapped with each other in a vertical direction.

According to another embodiment of the invention, there is provided an information transmission system comprising:

one of the above onboard systems; and a ground system including M types of track antennae selected from N types of track antennae with different resonance frequencies, N being larger than M, M being equal to or larger than 2, the M types of track antennae being arranged side by side in a left and right direction relative to a traveling direction of the train or arranged to be partially or entirely overlapped with each other in a vertical direction.

[System]

FIG. 1 is a diagram illustrating a configuration of an information transmission system 1 according to the present embodiment. The information transmission system 1 illustrated in FIG. 1 includes an onboard system 20 installed in a train 10 that travels along a track R and a ground system 40 provided along the track R. When the train 10 passes through the position where the ground system 40 is provided, the ground system 40 transmits information to the onboard system 20. The present embodiment is described with the train 10 serving as a vehicle that travels on rails provided along the track R. Note that a guideway may be provided along the track R if the vehicle travels on rubber tires or the like.

Figure 2:
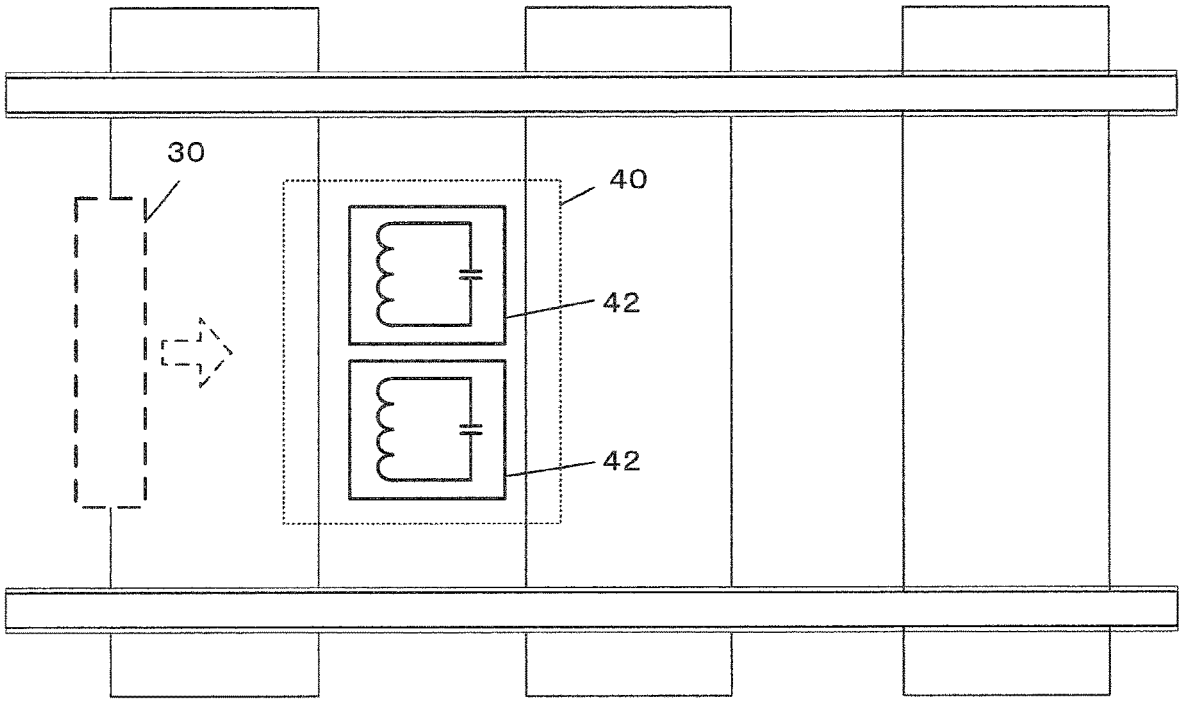
FIG. 2 illustrates an example of how a ground system is installed.

The ground system 40 includes two (M=2) track antennae 42 formed of resonant circuits with different resonance frequencies each selected from N types (N≥3) of different resonance frequencies. FIG. 2 illustrates an example of how the track antennae 42 are installed. As illustrated in FIG. 2, the two track antennae 42 of the ground system 40 are arranged side by side in a left and right direction (in a direction along a railroad tie between the rails in the present embodiment) relative to a traveling direction. When the train 10 passes through the installed position of the ground system 40, an onboard antenna 30, provided on a vehicle lower portion of the train 10, and the track antennae 42 are electromagnetically coupled to each other, so that the onboard system 20 of the train 10 can detect the two track antennae 42 at once. The two track antennae 42 can be arranged to be equally distant from the onboard antenna 30 to achieve substantially the same response characteristics.

The onboard system 20 "detects" the track antennae 42 by determining the resonance frequencies of the track antennae 42 on the basis of a signal (a frequency signal generated on the basis of the resonance frequencies of the track antennae) generated by the onboard antenna 30 as a result of electromagnetically coupling with the track antennae 42. The onboard system 20 can discriminate among the N types of resonance frequencies, and stores therein a code information table 114 in which a code information is associated with each possible combination between two types of the resonance frequencies. The onboard system 20 controls the train on the basis of code information associated with a combination of the resonance frequencies of the track antennae 42 detected at once. Thus, in the information transmission system 1, an information code is transmitted from the ground system 40 to the onboard system 20, on the basis of the combination of the resonance frequencies of the two track antennae 42 of the ground system 40.

The onboard system 20 determines the resonance frequencies of the track antennae 42 by using a Q factor. The Q factor, which may be calculated in any suitable way, is obtained from a current (onboard antenna current) of the onboard antenna 30 in the present embodiment. More specifically, the onboard antenna 30 transmits (emits) a composite signal obtained by combining N types of resonance frequencies $f_{i0}$ (i=1, . . . , N) with cutoff frequencies $f_{id}$ (i=1, . . . , N) respectively corresponding to the resonance frequencies $f_{i0}$ (i=1, . . . , N). Then, a current (onboard antenna current) I of the onboard antenna 30 is calculated to determine a resonance frequency $f_{a0}$ and a resonance frequency $f_{b0}$ respectively corresponding to a current $I_{a0}$ and a current $I_{b0}$ that are the highest and the second highest ones of onboard antenna currents $I_{i0}$ (i=1, . . . , N) respectively corresponding to the resonance frequencies $f_{i0}$ (i=1, . . . , N). Then, the Q factor is calculated for each of the two resonance frequencies $f_{a0}$ and $f_{b0}$, from cutoff frequencies $f_{ad}$ and $f_{bd}$ respectively corresponding to the resonance frequencies $f_{a0}$ and $f_{b0}$, onboard antenna currents $I_{a0}$ and $I_{b0}$ respectively corresponding to the resonance frequencies $f_{a0}$ and $f_{b0}$, and onboard antenna currents $I_{ad}$ and $I_{bd}$ respectively corresponding to the cutoff frequencies $f_{ad}$ and $f_{bd}$, on the basis of the following Formula (1):

$$Q=|f_{m0}/2(f_{m0}-f_{md})|\sqrt{2(I_{m0}/I_{md})^2-1} \quad \text{[Formula 1]}$$

According to Formula (1), the Q factor can be obtained for the track antenna 42 on the basis of a resonance frequency $f_{m0}$ of the track antenna 42, a cutoff frequency $f_{md}$, an onboard antenna current $I_{m0}$ corresponding to the resonance frequency $f_{m0}$, and an onboard antenna current $I_{md}$ corresponding to the cutoff frequency $f_{md}$. The track antennae 42 with the resonance frequencies $f_{a0}$ and $f_{b0}$ are determined to have been detected when the Q factor of each of the two resonance frequencies $f_{a0}$ and $f_{b0}$ exceeds a predetermined threshold.

[Functional Configuration]

Figure 3:
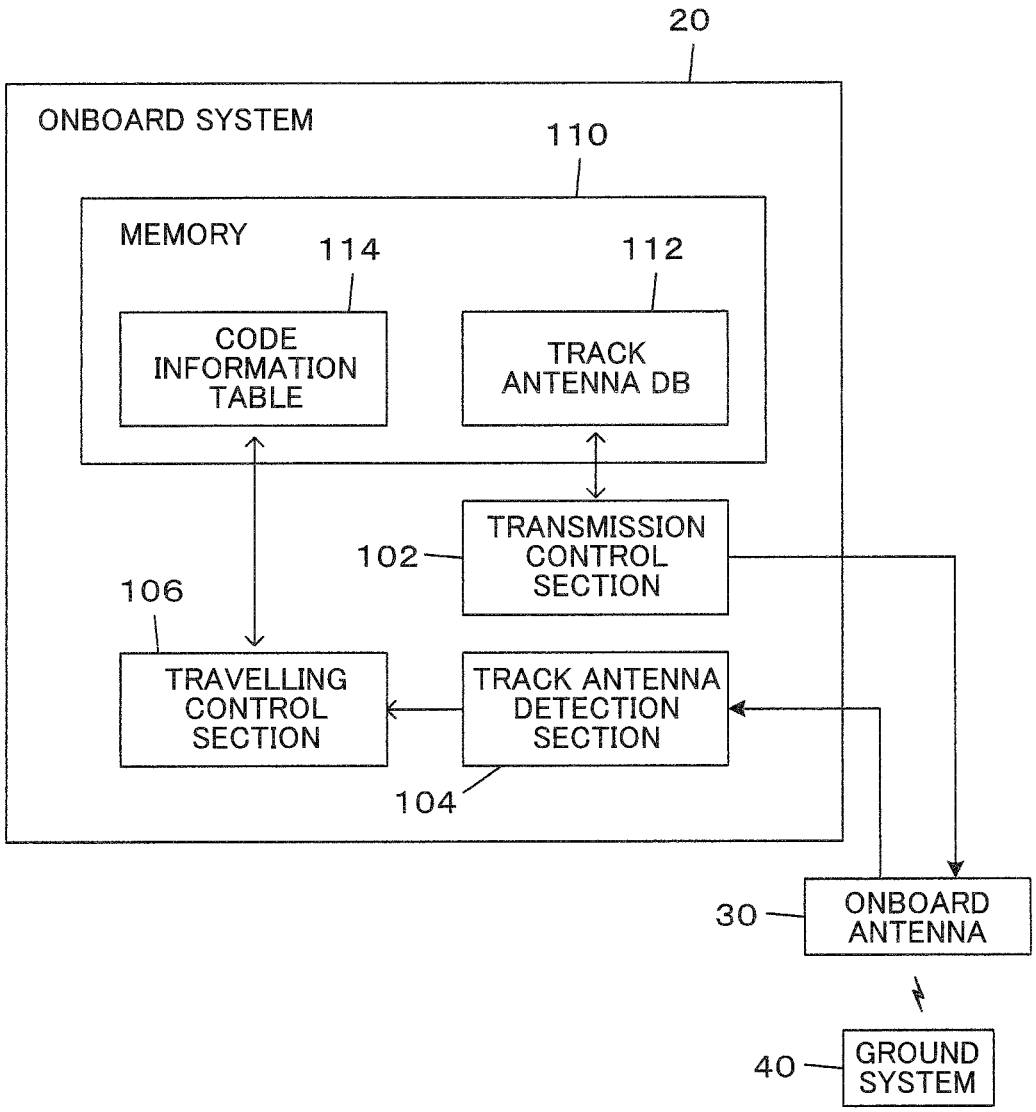
FIG. 3 is a diagram illustrating functional configurations of an onboard system.

FIG. 3 is a diagram illustrating a configuration in the onboard system 20. As illustrated in FIG. 3, the onboard system 20 includes a processor and a memory 110 serving as a storage section and the like. The processor includes a central processing unit (CPU), an application specific integrated circuit (ASIC), a field-programmable gate array (FPGA), and the like. The storage section includes a random access memory (RAM), a read only memory (ROM), and the like. The track antennae 42 through which the train 10 has passed are detected and traveling control is performed on the basis of a result of the detection, with a program stored in the memory 110 executed. Functional sections implemented when the program is executed include a transmission control section 102, a track antenna detection section 104, and a traveling control section 106. The onboard system 20 further includes unillustrated functions such as a display section including a display, a light emitting diode, and the like, an operation section for performing a setting operation, and a communication section in charge of communicating with the external.

The transmission control section 102 generates the composite signal obtained by combining the N types of resonance frequencies $f_{i0}$ (i=1, . . . , N) with the cutoff frequencies $f_{id}$ (i=1, . . . , N) respectively corresponding to the resonance frequencies $f_{i0}$ (i=1, . . . , N). The composite signal thus generated is constantly emitted from the onboard antenna 30. The N types of resonance frequencies $f_{i0}$ (i=1, . . . , N) are resonance frequencies of the track antennae 42 that may be arranged along the track R, and can be determined by referring to a track antenna DB 112 in the memory 110. For each of the track antennae 42 arranged as described above, the installed position, the resonance frequency, and the like are stored in the track antenna DB 112 while being associated with each other.

The track antenna detection section 104 measures the current (onboard antenna current) of the onboard antenna 30, and uses the onboard antenna current to detect that the train 10 has passed through the track antenna 42 and to determine the resonance frequency of each of the two track antennae 42 detected at once. More specifically, the resonance frequency $f_{a0}$ and the resonance frequency $f_{b0}$ respectively corresponding to the current $I_{a0}$ and the current $I_{b0}$ that are the highest and the second highest ones of the onboard antenna currents $I_{b0}$ (i=1, . . . , N) respectively corresponding to the N types of resonance frequencies $f_{i0}$ (i=1, . . . , N) are determined. Then, the Q factor is calculated for each of the two resonance frequencies $f_{a0}$ and $f_{b0}$, from the cutoff frequencies $f_{ad}$ and $f_{bd}$ respectively corresponding to the resonance frequencies $f_{a0}$ and $f_{b0}$, the onboard antenna currents $I_{a0}$ and $I_{b0}$ respectively corresponding to the resonance frequencies $f_{a0}$ and $f_{b0}$, and the onboard antenna currents $I_{ad}$ and $I_{bd}$ respectively corresponding to the cutoff frequencies $f_{ad}$ and $f_{bd}$, on the basis of Formula (1). The track antennae 42 with the resonance frequencies $f_{a0}$ and $f_{b0}$ are determined to have been detected when the Q factor of each of the two resonance frequencies $f_{a0}$ and $f_{b0}$ exceeds a predetermined threshold.

The traveling control section 106 performs the traveling control for the train on the basis of the code information corresponding to the combination of the resonance frequencies of the track antennae 42 detected/determined by the track antenna detection section 104 by referring to the code information table 114 of the memory 110.

Advantageous Effects

As described above, in the information transmission system 1 according to the present embodiment, the two (M=2) track antennae 42, selected as the two track antennae 42 forming a single ground system 40 from the N types of track antennae with different resonance frequencies, are arranged side by side in the left and right direction relative to the traveling direction. Thus, the onboard system 20 can detect the two track antennae 42 at once, and determine the resonance frequencies of the track antennae 42. Here, N×(N−1)/2 types of code information can be transmitted, with a combination of the two types of resonance frequencies detected/determined at once regarded as a single piece of information. Thus, a wider range of information can be transmitted to the onboard system 20 than in a case where a single track antenna is provided.

The determination on the resonance frequencies of the track antenna 42 by the onboard system 20 is based on the Q factor so as not to be affected by swinging of the vehicle body or noise. Thus, higher detection performance can be achieved for the track antenna 42. Furthermore, the track antenna 42 can be downsized, so that the two track antennae 42 can be arranged side by side between the left and right rails.

The invention is not limited to the above embodiments. Various modifications and variations may be made without departing from the scope of the invention.

(A) Arrangement of the Track Antennae

The two track antennae of the ground system may be arranged to be partially or entirely overlapped with each other in a vertical direction (upper and lower direction) instead of being arranged side by side in the left and right direction relative to the traveling direction.

(B) The Number M of the Track Antennae of the Ground System

A single ground system 40 may include three or more (M≥3) track antennae 42 with different resonance frequencies. The three or more track antennae 42 may be arranged side by side in the left and right direction relative to the traveling direction, or may be arranged to be partially or entirely overlapped with each other in the vertical direction. The track antenna detection section 104 of the onboard system 20 determines whether the predetermined threshold is exceeded by the Q factor corresponding to each of the three highest onboard antenna currents in the onboard antenna currents $I_{i0}$ (i=1, . . . , N) respectively corresponding to the N types of resonance frequencies $f_{i0}$ (i=1, . . . , N), to determine whether or not the track antennae 32 with the three resonance frequencies are detected.

(C) The Ground System can Include any Number of Ground Antennae

A single ground system 40 may include any number of track antennae 42 with different resonance frequencies (for example, one ground system may include a track antenna with a single resonance frequency, while another ground system includes two track antennae with different resonance frequencies).

In such a case, the track antenna detection section 104 of the onboard system 20 may determine whether or not the predetermined threshold is exceeded by the Q factor corresponding to each of the onboard antenna currents $I_{i0}$ (i=1, . . . , N) respectively corresponding to the N types of resonance frequencies $f_{i0}$ (i=1, . . . , N), and may determine that the antennae with all the resonance frequencies corresponding to the onboard antenna currents corresponding to the Q factor exceeding the predetermined threshold are detected.

Although only some embodiments of the present invention have been described in detail above, those skilled in the art will readily appreciate that many modifications are possible in the embodiments without materially departing from the novel teachings and advantages of this invention. Accordingly, all such modifications are intended to be included within scope of this invention.

What is claimed is:

1. An onboard system installed in a train that travels along a track, the track having a ground system provided at a predetermined position, the ground system including M types of track antennae selected from among N types of track antennae formed of resonant circuits having fixed resonance frequencies, the resonance frequencies being different from each other, the M types of track antennae being arranged to be entirely or partially overlapped with each other in a vertical direction, N being larger than M, M being equal to or larger than 2, the onboard system comprising:

a transmission control section causing an onboard antenna to transmit a signal that provides frequency signals corresponding to a resonance frequency of each of the N types of track antennae;

a track antenna detection section determining a combination of the M types of resonance frequencies detected when the M types of resonance frequencies are detected at once on the basis of the frequency signals generated in the onboard antenna; and a traveling control section performing traveling control for the train on the basis of information associated with the determined combination of the M types of resonance frequencies.

2. The onboard system as defined in claim 1, the track antenna detection section performing calculating all Q factors of each of the N types of resonance frequencies on the basis of the frequency signal, and detecting the M types of resonance frequencies at once by detecting a resonance frequency corresponding to the Q factor satisfying a predetermined threshold condition.

3. An information transmission system comprising:

the onboard system according to claim 1; and a ground system including M types of track antennae selected from among N types of track antennae formed of resonant circuits having fixed resonance frequencies, resonance frequencies being different from each other, N being larger than M, M being equal to or larger than 2, the M types of track antennae being arranged to be partially or entirely overlapped with each other in a vertical direction.

4. The onboard system as defined in claim 1, the track antenna detection section performing selecting M highest signal currents from among N signal currents respectively corresponding to the N types of resonance frequencies on the basis of the frequency signals generated in the onboard antenna, calculating Q factors of the resonance frequencies of the selected M signal currents, and determining the combination of the M types of resonance frequencies by the calculated M Q factors all satisfying a predetermined threshold condition.

5. An onboard system as defined in claim 1, the transmission control section causing the onboard antenna to transmit a composite signal of the resonance frequencies of each of the N types of track antennae and cutoff frequencies corresponding to each of the resonance frequencies.

6. A ground system provided to a track along which a train including the onboard system according to claim 1 travels, the ground system comprising M types of track antennae selected from among N types of track antennae formed of resonant circuits having fixed resonance frequencies, the resonance frequencies being different from each other, the M types of track antennae being arranged to be partially or entirely overlapped with each other in a vertical direction, N being larger than M, M being equal to or larger than 2.

7. An onboard system installed in a train that travels along a track, the track having a ground system provided at a predetermined position, the ground system including M types of track antennae selected from among N types of track antennae formed of resonant circuits having fixed resonance frequencies, the resonance frequencies being different from each other, the M types of track antennae being arranged side by side in a left and right direction relative to a traveling direction of the train, N being larger than M, M being equal to or larger than 2, the onboard system comprising:

a transmission control section causing an onboard antenna to transmit a signal that provides frequency signals corresponding to a resonance frequency of each of the N types of track antennae;

a track antenna detection section determining a combination of the M types of resonance frequencies detected when the M types of resonance frequencies are detected at once on the basis of the frequency signals generated in the onboard antenna; and a traveling control section performing traveling control for the train on the basis of code information associated with the determined combination of the M types of resonance frequencies, the track antenna detection section performing calculating all Q factors of each of the N types of resonance frequencies in the frequency signals, and detecting the M types of resonance frequencies at once by detecting a resonance frequency corresponding to the Q factor satisfying a predetermined threshold condition.

8. A ground system provided to a track along which a train including the onboard system according to claim 7 travels, the ground system comprising M types of track antennae selected from among N types of track antennae formed of resonant circuits having fixed resonance frequencies, the resonance frequencies being different from each other, the M types of track antennae being arranged side by side in a left and right direction relative to a traveling direction of the train, N being larger than M, M being equal to or larger than 2.

9. An information transmission system comprising:

the onboard system according to claim 7; and a ground system including M types of track antennae selected from among N types of track antennae formed of resonant circuits having fixed resonance frequencies, the resonance frequencies being different from each other, the M types of track antennae being arranged side by side in a left and right direction relative to a traveling direction of the train, N being larger than M, M being equal to or larger than 2.

10. An onboard system installed in a train that travels along a track, the track having a ground system provided at a predetermined position, the ground system including M types of track antennae selected from among N types of track antennae formed of resonant circuits having fixed resonance frequencies, the resonance frequencies being different from each other, the M types of track antennae being arranged side by side in a left and right direction relative to a traveling direction of the train, N being larger than M, M being equal to or larger than 2, the onboard system comprising:

a transmission control section causing an onboard antenna to transmit a signal that provides frequency signals corresponding to a resonance frequency of each of the N types of track antennae;

a track antenna detection section determining a combination of the M types of resonance frequencies detected when the M types of resonance frequencies are detected at once on the basis of the frequency signals generated in the onboard antenna; and a traveling control section performing traveling control for the train on the basis of code information associated with the determined combination of the M types of resonance frequencies, the track antenna detection section performing selecting M highest signal currents from among N signal currents respectively corresponding to the N types of resonance frequencies on the basis of the frequency signals generated in the onboard antenna, calculating Q factors of the resonance frequencies of the selected M signal currents, and determining a combination of the M types of resonance frequencies by the calculated M Q factors all satisfying a predetermined threshold condition.

11. A ground system provided to a track along which a train including the onboard system according to claim 10 travels, the ground system comprising M types of track antennae selected from among N types of track antennae formed of resonant circuits having fixed resonance frequencies, the resonance frequencies being different from each other, the M types of track antennae being arranged side by side in a left and right direction relative to a traveling direction of the train, N being larger than M, M being equal to or larger than 2.

12. An information transmission system comprising:

the onboard system according to claim 10; and a ground system including M types of track antennae selected from among N types of track antennae formed of resonant circuits having fixed resonance frequencies, the resonance frequencies being different from each other, the M types of track antennae being arranged side by side in a left and right direction relative to a traveling direction of the train, N being larger than M, M being equal to or larger than 2.

* * * * *